United States Patent [19]

Baldwin

[11] Patent Number: 4,907,904

[45] Date of Patent: Mar. 13, 1990

[54] NOTEBOOK WITH SELECTIVELY CHANGEABLE, REMOVEABLE AND REPLACEABLE INFORMATION CARRIERS

[75] Inventor: Judith A. M. Baldwin, New York, N.Y.

[73] Assignee: Strategic Financial Communications Corp., New York, N.Y.

[21] Appl. No.: 206,428

[22] Filed: Jun. 14, 1988

[51] Int. Cl.[4] ..... B42F 13/00

[52] U.S. Cl. ..... 402/80 R; 281/21.1; 283/81; 283/43; 283/46; 402/79

[58] Field of Search ..... 281/21.1; 282/2, 3 R; 283/81, 43, 46; 402/79, 80 R

[56] References Cited

U.S. PATENT DOCUMENTS

| | | | |
|---|---|---|---|
| 1,682,192 | 8/1928 | Schoolberg | 402/79 X |
| 3,290,059 | 12/1966 | Newman | 283/81 X |
| 4,165,193 | 8/1979 | Gestetner . | |
| 4,190,268 | 2/1980 | Webster | 282/3 R |
| 4,468,053 | 8/1984 | Bradley . | |
| 4,500,021 | 2/1985 | Bildusas . | |
| 4,634,146 | 1/1987 | Yaniv | 283/43 X |
| 4,802,855 | 2/1989 | Wood | 283/46 X |
| 4,803,795 | 2/1989 | Questel et al. | 402/79 X |
| 4,807,909 | 2/1989 | Lapsker | 283/900 X |
| 4,815,766 | 3/1989 | Buchanan | 283/43 X |

*Primary Examiner*—Paul A. Bell

[57] ABSTRACT

A notebook with selectively changeable, removable and replaceable information carriers, comprising: (a) a plurality of notebook pages of glossy paper having alignment indicia printed thereon to divide said pages into multiple label-support zones; (b) a series of information carriers in the form of pressure-sensitive labels; (c) said labels including preprinted information, designations and space for inclusion by hand of further information; (d) whereby each of said labels may be selectively moved and replaced to and from any of said label-support zones; and, (e) book cover means binding said pages together.

4 Claims, 1 Drawing Sheet

NOTEBOOK WITH SELECTIVELY CHANGEABLE, REMOVEABLE AND REPLACEABLE INFORMATION CARRIERS

BACKGROUND OF THE INVENTION

It is well-known that address books, telephone books, daily dairies and other personal books in which information (in the form of names, addresses, telephone numbers, calendar dates and the like) is recorded for future reference often become cluttered and of reduced usefulness through the passage of time. This is typically due to the repeated need to amend entries, remove them, or to rearrange them entailing messy erasures, strikeovers, white-outs, etc.

The most common solution to the problem has been to simply replace these books on a regular basis requiring the time-consuming reentry of information from the old book to the new. Other solutions have included the use of selectively removable and rearrangeable pages (such as in loose-leaf notebooks). However, this system allows saving and/or rearranging of full pages of information rather than individual entries. Another solution has entailed the use of pages having multiple transparent pockets into which individual business cards or other information bearing elements may be inserted, removed and/or rearranged.

SUMMARY OF THE PRESENT INVENTION

A new and improved personal information system for maintaining, on a semipermanent basis, the type of personal information described hereinabove, has been perfected and is embodied in the notebooks of the present invention.

Specifically, the new notebooks may be in bound or loose-leaf form, with the salient features being the association with and inclusion within the book of a supply of information carriers in the form of pressure-sensitive adhesive coated removable labels, either blank or preferably preprinted, with typical diary information such as name, address and telephone number(s) or other calendar or reminder information, and special coated pages for readily removably mounting the pressure-sensitive adhesive labels.

The individual labels, after being initially filled in with information, may be replaced or rearranged as desired in the appropriately indexed portion of the book. Thus, "Jane Doe" would originally be placed in the "D" section of the book. However, upon marrying "John Smith", her label could be amended and moved to the "S" section.

For a more complete understanding of the new and improved notebooks of the present invention and for a better appreciation of the advantages to be derived from their use, reference should be made to the following detailed description, taken in conjunction with the accompanying drawings.

DETAILED DESCRIPTION OF THE INVENTION

Figure 1:
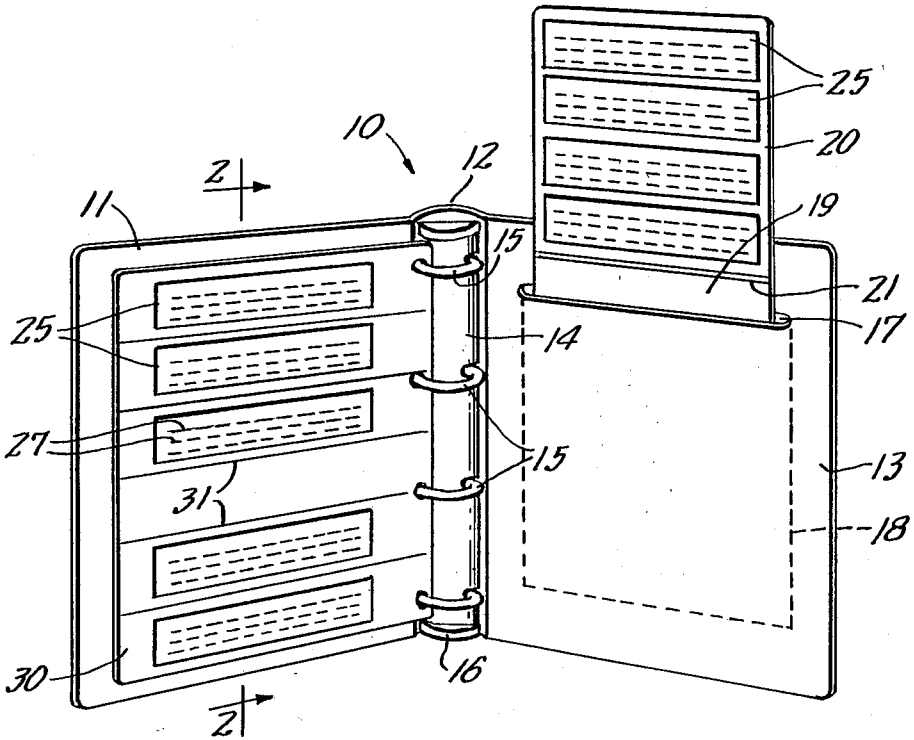
FIG. 1 is a front elevational view of a preferred embodiment of the present invention, including a conventional ring-binder, special coated loose-leaf pages, and a supply of pressure-sensitive adhesive coated information labels; and, FIG. 2 is a cross-sectional view of a page taken along the Line 2—2 of FIG. 1.

Referring now to FIG. 1, the new and improved notebook of the present invention includes a loose-leaf ring binder 10, having a front cover 11, a spine 12, and rear cover 13, the spine 12 mounting a standard ring-binder 14 having rings 15 which may be opened and closed through an operating lever 16. The covers and spine are formed from a single layer of articulated plastic or stiff paperboard enveloped by vinyl sleeve, cloth, leather, or the like, as is well-known in the art. A tab receiving slit 17 is provided in the rear cover 13 and forms the opening of a pocket 18 for receiving a tab 19 of a label "parking" board 20 hinged along fold line 21 to the tab 19. A second "parking" board may be similarly mounted on the front cover.

The removable information carrier labels 25 of the invention may be supplied in pad form (not illustrated) as well as being pre-installed on both sides of each page or leaf 30 of the book 10 (only one of which pages has been illustrated). These pages 30 have holes 30' and may be lined or provided with indicia 31 to facilitate orderly attachment and replacement of labels 25.

Figure 2:
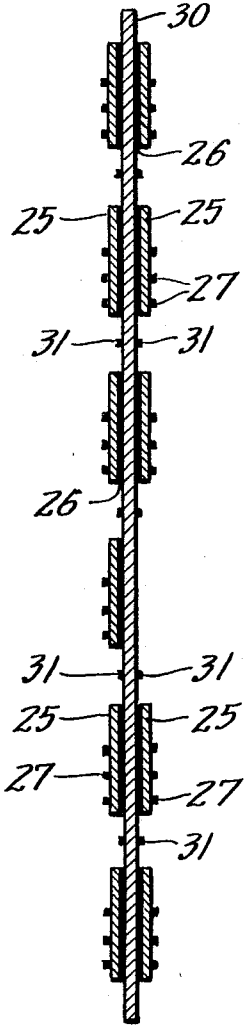

In accordance with the invention, each of the pages 30 of the new book is made from glossy sheets of coated or waxed paper or sheets of glossy plastic which have ready release and rebounding properties with respect to the pressure-sensitive adhesive coating 26 on each of the information carrier labels 25. More specifically, and referring to FIG. 2, the coatings 26 include pressure-sensitive adhesive compositions which are especially suitable for forming contact bonds that are releasable at room temperature. Such adhesive compositions include a blend of a linear or a radial block copolymer, an end-block modifying resin compatible with the end or thermoplastic or elastomeric block, a plasticizing process oil compatible with the mid or elastomeric block; and, only if desired, not more than about 14 weight percent of a mid block or elastomeric block associating or modifying resin compatible with the mid or elastomeric block and incompatible with the end or thermoplastic block and note pads and dispensers for thin storage wrap products. Examples of such coatings and more specific formulations thereof may be found in the specification of U.S. Pat. No. 4,500,021, which is incorporated by reference herein.

In use, the new notebook may be employed as follows. Assuming by way of example that the format is to be that of a simple address book with a name, address, and telephone number comprising the information to be included on a single label 25. In such an application, each label would be preprinted (and lined, if desired) with a "name ____", address "____", and "telephone number ____" graphics 27.

The pages of the book will initially be filled with blank labels. Alphabetized A–Z dividers or tabs may be employed to facilitate alphabetizing of the information. As the information on a particular label becomes outdated or obsolete, or if the location of the label 25 is no longer proper or optimal, one or more of the labels may be peeled off and relocated elsewhere in the book, as will be understood. If many labels are being removed and rearranged, necessitating temporary holding or "parking", labels "in transit" or "parked" may be held on the hinged "parking" board 20.

It will be appreciated that in accordance with the invention, a much-amended label may be removed from a page without interfering with any of the other labels or information and replaced with a fresh label. A label may be readily removed to a more appropriate location as often as required. Indeed, for changing books or formats of storage, all up-to-date labels may be peeled off the pages 30 and inserted into a fresh diary, address book or the like while all obsolete labels may be removed and destroyed.

It should be understood, of course, that the specific embodiment of the new and improved notebook herein illustrated and described is intended to be for the purpose of example and representative only, as certain changes may be made therein without departing from the clearing teachings of the disclosure. Accordingly, reference should be made to the following appended claims in determining the full scope of the invention.

I claim:

1. A personal notebook with readily selectively changeable, removable and replaceable information carriers, comprising:

(a) a plurality of notebook pages of paper having a coating with release and rebounding properties and having alignment indicia printed thereon to divide said pages into multiple label-support zones of predetermined first size and shape;

(b) a series of information carriers in the form of pressure-sensitive labels of predetermined second size smaller than said first size and of predetermined shape generally congruent with said first shape;

(c) said labels being of less than full page width and including preprinted information designations and space for inclusion by hand of further information;

(d) whereby each of said labels may be readily selectively moved and replaced to and from any of said label-support zones; and, (e) book cover means binding said pages together.

2. The notebook of claim 1 in which:

(a) said book cover means is a loose-leaf binder;

(b) said pages are in the form of loose-leaves for removable association with said binder.

3. The notebook of claim 1 in which:

(a) said pages are permanently bound in said cover means.

4. The notebook of claim 1 in which:

(a) at least one auxiliary pages is included for parking labels removed from or to be attached to said notebook pages.

* * * * *